United States Patent [19]

Kuru et al.

[11] Patent Number: 4,595,279

[45] Date of Patent: Jun. 17, 1986

[54] RECORDING APPARATUS WITH SPEED CONTROL

[75] Inventors: Hiroshi Kuru, Hachioji; Hirofumi Sakaguchi; Takao Shiozawa, both of Akigawa, all of Japan

[73] Assignee: Konishiroku Photo Ind. Co., Ltd., Tokyo, Japan

[21] Appl. No.: 658,394

[22] Filed: Oct. 5, 1984

[30] Foreign Application Priority Data

Oct. 6, 1983 [JP] Japan ..... 58-185976

[51] Int. Cl.[4] ..... G03G 15/00

[52] U.S. Cl. ..... 355/14 R; 355/3 SH; 355/3 FU; 355/14 FU

[58] Field of Search ..... 355/3 SH, 14 SH, 3 R, 355/14 R, 14 FU, 3 FU; 219/216

[56] References Cited

U.S. PATENT DOCUMENTS

| | | | |
|---|---|---|---|
| 3,926,519 | 12/1975 | Rebres | 355/14 FU |
| 4,095,886 | 6/1978 | Koeleman et al. | 355/3 FU |
| 4,279,504 | 7/1981 | Brown et al. | 355/14 SH X |
| 4,348,102 | 9/1982 | Sessink | 355/14 F UX |
| 4,362,502 | 12/1982 | Motomura et al. | 355/3 F UX |
| 4,373,801 | 2/1983 | Itoh | 355/3 F UX |
| 4,440,487 | 4/1984 | Miura | 355/3 SH X |
| 4,451,136 | 5/1984 | Tanioka et al. | 355/3 SH X |
| 4,455,018 | 6/1984 | Colglazier et al. | 355/3 SH X |
| 4,469,431 | 9/1984 | Miyoshi et al. | 355/3 SH |
| 4,494,858 | 1/1985 | Gage et al. | 355/3 SH X |

*Primary Examiner*—A. C. Prescott

*Attorney, Agent, or Firm*—Frishauf, Holtz, Goodman & Woodward

[57] ABSTRACT

A recording apparatus includes an electrostatic image support and a fixing device. The toner image formed on the electrostatic image support is transferred onto a copy paper, and the copy paper is separated from the surface of the electrostatic image support and then fed to the fixing device to fuse the toner image, for example by heat. A device is provided for distinguishing the relation in the length between the distance (A) from the separating position at which the copy paper is separated from the electrostatic image support to the fixing position of the fixing device, and the length (B) of the copy paper in the transport direction. A control device controls the relative circumferential speeds of the electrostatic image support and the copy paper transport apparatus provided inside the fixing device as a function of the distinguished relation between said lengths (A) and (B).

16 Claims, 3 Drawing Figures

RECORDING APPARATUS WITH SPEED CONTROL

BACKGROUND OF THE INVENTION

1. Field of the Invention

The present invention relates to recording apparatus such as electrophotographic copying apparatus, and more particularly to a recording apparatus which is improved so as to produce a clear, unblurred image and/or to fix the toner with efficient use of energy.

2. Description of the Prior Art

In electrostatic recording apparatus such as electrophotographic copiers or facsimile apparatus (hereinafter referred to as "recording apparatus"), the formation of an image to be recorded is carried out by an exposure operation. It involves light reflected off a document glass plate (copy board) carrying an original through an optical system including a lens and mirrors and onto an electrostatic image support means such as a photoreceptor known in the prior art (e.g., Se or an organic photoconductor). This results in the formation on a dielectric of an electrostatic image corresponding to the original, or an electrostatic image of an original, or of an image derived from electric information signals transmitted from the outside. The electrostatic image is developed to be a visible image (toner image); the visible image is transferred onto a copy paper supplied from a given position; and the transferred image is then fixed onto the paper to thereby form a recorded image.

For convenience's sake, the process of image formation as known in the prior art will be illustrated in detail by FIG. 1 which is a schematic drawing showing the construction of an electrophotographic copying apparatus. A document G is placed on a document glass plate 1 which is arranged to be movable in reciprocating motion in the directions of the arrows. The document is illuminated scanningly through a slit (not shown) by a stationary lamp 2, and the reflected light from document G is projected through fixed mirror 3, fixed lens L, and fixed mirror 3' upon a photoreceptor 4a that is formed on the surface of a rotary drum 4, whereby an electrostatic image corresponding to the foregoing document is formed. In the present invention, the latent image-forming system comprised of the foregoing illuminating lamp, lens and mirrors will sometimes be called the "optical system" or "optical device."

The electrostatic image is converted into a toner image by any well known developing means 6, such as a magnetic brushtype developing device, arranged in the proximity of the periphery of rotary drum 4 (hereinafter called "photoreceptor drum"). At this moment, a copy paper P that has been transported from a paper feed bin 7 by roller 8 rests with its trailing end nipped by and between a pair of register rollers 9.

After that, upon the action of the above register rollers in response to a signal from movable document glass plate 1 or from photoreceptor drum 4, the copy paper P with its one-side surface brought into contact with the toner image area on the photoreceptor drum passes above image transfer means 10. During this passage, the action of the transfer means transfers the toner image onto the copy paper. In this process, both drum and paper are in an electrostatically mutually attracting condition (particularly conspicuous where the copy paper is thin and lacking in rigidness). In practice, the separation of the paper from the photoreceptor drum is accelerated by the action of a separating means 11 that is connected to an AC power supply, or the like. The separating means is allowed to be a separating claw or a separating electrode in combination with the separating claw. The trailing end-separated paper sheet is led by the action of a transport belt 16 up to a fixing device 17. The fixing device in the example has therein a thermal source element such as a halogen lamp (not shown) and is a roller-type fixing device comprised of a heat roller 17a and pressure roller 17b that revolves pressing against the heat roller. The heat and pressure by the pair of rollers 17a and 17b fuse the toner image onto the copy paper. The fused toner image-bearing copy paper is then ejected from the apparatus by a pair of ejecting rollers 18.

The means arranged around photoreceptor drum 4 are a charge-eliminating electrode 12 for eliminating the residual charge remaining on photoreceptor drum 4, a cleaning device 13 for cleaning up the residual toner on photoreceptor drum 4, an exposure-prior-to-charging lamp 14 for neutralizing the needless charge still remaining on the photoreceptor drum after the charge elimination by charge-eliminating electrode 12, and a charging electrode 5 located adjacent to lamp 14. Further, an exposure-prior-to-transfer lamp 15 is provided for facilitating the transfer onto copy paper P of the toner image formed by developing means 6 on the photoreceptor drum 4. Lamp 15 is positioned adjacent to with toner image-transfer electrode 10. In addition, photoreceptor drum 4, heat roller 17a of fixing device 17, and document glass plate 1 are adapted to be driven through means, such as a clutch (not shown), by a single motor M or a plurality of motors.

Incidentally, in conventional-type apparatus, circumferential speed $V_2$ of heat roller 17a of fixing device 17 is usually set to be the same as circumferential speed $V_1$ of photoreceptor drum 4. With this arrangement, however, if the apparatus is a high-speed recording machine, the surface temperature at the contact point of heat roller 17a with pressure roller 17b does not rise high enough to fix the transferred image because of the nearly continuous absorption of the heat by the copy paper. Consequently, a poor, under-fixed image is the result.

A solution to the above problem without increasing power consumption may be accomplished by setting circumferential speed $V_2$ of heat roller 17a to be lower than circumferential speed $V_1$ of photoreceptor drum 4. This, however, produces another problem in that the distance (hereinafter regarded as A) between the point on photoreceptor drum 4 opposite to separation electrode 11 (separating position) and the contact point of heat roller 17a with pressure roller 17b (fixing position) must be longer than the length in the transport direction of copy paper P. If it is not, that is if length B of copy paper P is longer than distance A, then even if the leading end of copy paper P is nipped by and between heat roller 17a and pressure roller 17b, the trailing end of paper P still remains attracted electrostatically and attached to photoreceptor drum 4 (still not separated). In other words, because $V_1 > V_2$, the feed speed of copy paper P corresponding to $V_1$ of the photoreceptor drum is forcibly restrained by the heat and pressure rollers rotating at only $V_2$. As a result, the trailing end of paper P slips out of the toner image on photoreceptor drum 4, thus producing a "blurred image".

Of course, no "blurred image" problem occurs if distance A is longer than length B in the transport direction of copy paper P because the feed speed of copy paper P in the image transfer position is governed solely by circumferential speed $V_1$ of photoreceptor drum 4.

The above blurred image problem may be solved be designing either to make distance A from separation electrode 11 to fixing device 17 (up to the paper-nipping point between the pair of rollers 17*a* and 17*b* in the exemplified drawing) longer than length B in the transport direction of a copy sheet of the largest size (e.g., A3) among those used or to make circumferential speed $V_2$ of the pair of rollers 17*a* and 17*b* faster to be equal to circumferential speed $V_1$. The former method, however, requires the recording apparatus to be oversize contrary to the tendency toward reducing in size the recording apparatus. The latter method requires an increase the supply of power to the thermal source element (such as a halogen lamp, not shown) for fixation in order to prevent the occurrence of possible under-fixing problems even when copy paper sheets of a large size pass in succession. Consequently this method is disadvantageous in that it results in consumption of more electricity.

OBJECT AND CONSTRUCTION OF THE INVENTION

The present invention has been made to improve the above-mentioned shortcomings.

It is, therefore, an object of the present invention to provide recording apparatus which is improved so as to prevent the occurrence of a "blurred image" while making efficient use of electricity.

According to a principal feature of this invention the recording apparatus has a means to distinguish length B of the copy paper from distance A between the separating position and the fixing position to thereby vary relatively the speed of the electrostatic charge support means (the photoreceptor drum in the example; provided, however, this is allowed to be either an endless-type photoreceptor or a dielectric as has been mentioned earlier) and the speed of the copy paper transfer means that governs the transport of the copy paper inside the fixing device (the pair of rollers 17*a* and 17*b* in the example; in an oven-type fixing device, the transport means corresponds to those rollers governing the transport of copy paper in the device).

The bases for varying the speeds is classified into the following three categories:

(i) The circumferential speed of the electrostatic image support means and that of the copy paper transport means are variable. If, for example, the copy paper size used is changed to a larger size with its length B longer than distance A, the respective circumferential speeds of both means are changed to be the same. The standard condition (where length B of copy paper is smaller than distance A) may be either such that the circumferential speeds of both means are different (e.g., in the way the foregoing support means is faster) or such that both means run at the same circumferential speed which is different from the speed mentioned above.

(ii) The circumferential speed of the copy paper transport means is set to be a smaller constant speed than that of the electrostatic image support means. If the copy paper size used is changed to a larger size with its length B longer than distance A, the circumferential speed of the electrostatic image support means is controlled to be reduced so as to be substantially the same as that of the copy paper transport means. The standard condition is the case where length B of copy paper is smaller than distance A.

(iii) The circumferential speed of the electrostatic image support means is set to be a larger constant speed than that of the copy paper transport means. If the copy paper size used is changed to a larger size with its length B longer than distance A, the circumferential speed of the copy paper transport means is controlled to be increased so as to be substantially the same as that of the electrostatic image support means. The standard condition is where length B of copy paper is smaller than distance A.

EFFECT OF THE INVENTION

According to the present invention, recording apparatus is so improved that, according to the relation between the length of copy paper used and the distance from the separating position to the fixing position, the circumferential speed of the copy paper transport means and that of the electrostatic image support means, such as photoreceptor drum inside the apparatus, are variably controlled. Thus, even when the trailing end of the copy sheet still remains in the image transfer position and the leading end arrives at the fixing position, the feed speed of the copy paper is by no means restrained. Consequently, the blurred image problem at the trailing end of the copy sheet can be easily prevented. And even if the apparatus is of a high-speed type, the occurrence of the under-fixing trouble can be prevented sufficiently, thus enabling effective fixation.

With the present invention, because there is no need to always keep the circumferential speed of the heat roller high as in conventional roller-type fixing devices, a power boost to the fixing heater is not required. Thus, it thus is advantageous also in reducing power consumption. Further, because there is no need of to increase the distance between the separating position and the fixing position, the apparatus will not be oversize.

DETAILED DESCRIPTION OF THE INVENTION

Figure 1:
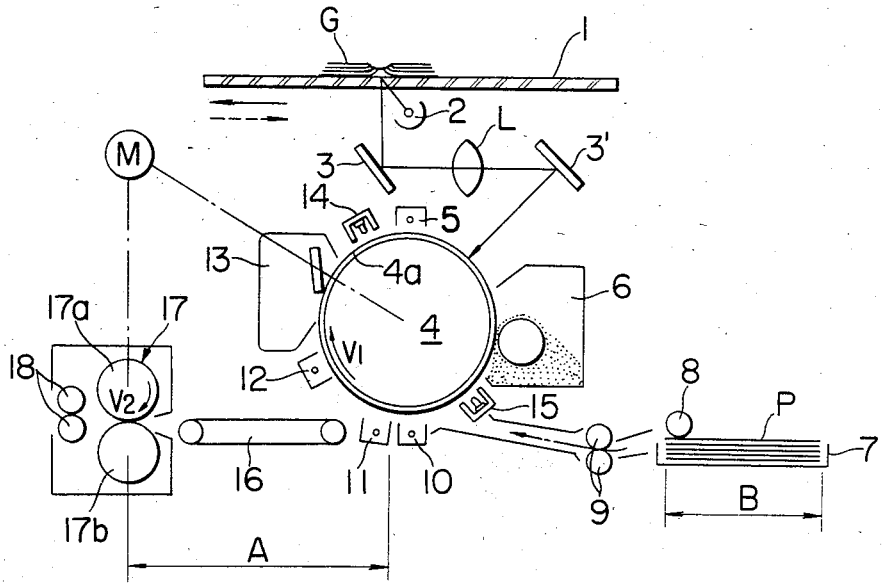
FIG. 1 PRIOR ART
FIG. 1 is a schematic drawing showing the construction of a prior art electrophotographic copying apparatus.

The present invention will be illustrated below in accordance with FIGS. 2 and 3. These drawings show electrophotographic apparatus of almost the same construction as that of FIG. 1 except for the reference numbers 20 to 23. Therefore elements numbered the same in these drawings as those in FIG. 1 are the same components as those of FIG. 1; no description will be repeated for the same components.

Figure 2:
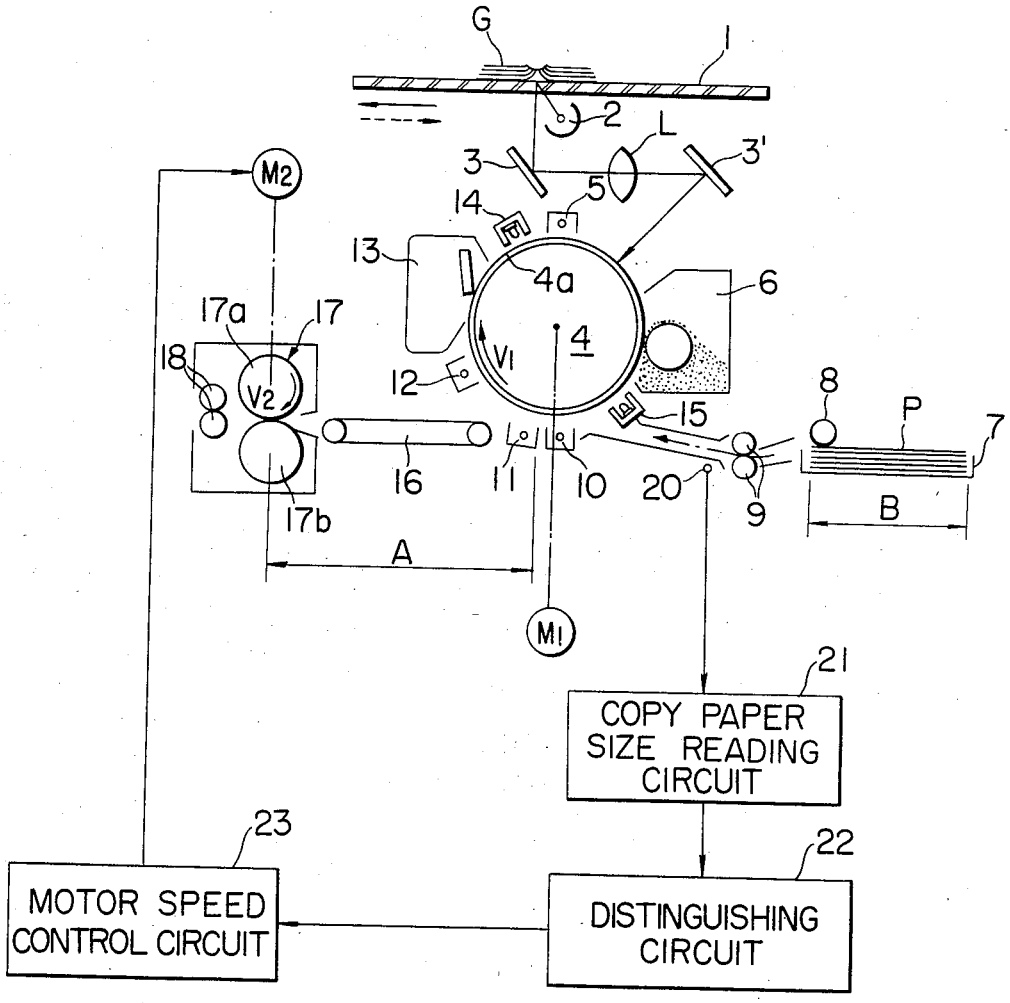
FIG. 2 is a schematic drawing showing one embodiment of an electrophotographic copying apparatus in accordance with one embodiment of the present invention.

In the example shown in FIG. 2, photoreceptor drum 4 and heat roller 17*a* are connected through a conventional driving system to motors M1 and M2, respectively. Motors M1 and M2 are desirable to be controlled as in of the prior art so as to operate the above photoreceptor drum and roller, respectively, only when necessary. Pressure roller 17*b* is adapted to be rotated synchronously with heat roller 17*a* through means such as gears. The photoreceptor drum is rotated at a constant speed $V_1$. The pair of rollers 17*a* and 17*b* are connected through motor M2 to motor speed control circuit 23 so that the rollers are variably controllable as to speed. Element 20 is a copy-paper-size sensor composed of a light-emitting element and a light-receiving element which are arranged (when viewed from the position of paper feeding roller 8) on the side of transfer electrode 10 rather than on the side of register rollers 9, the paper size sensor detecting optically length B in the advance direction of copy paper B. Sensor 20 may also be adopted to read copy paper size through paper supply cassette 7. Element 21 is a copy paper size reading circuit which reads out length B in the advance direction of copy paper P in accordance with the copy paper size signal detected by sensor 20. Element 22 is a distinguishing circuit which compares length B in the advance direction of copy paper P that has been read out by reading circuit 21 with distance A between separation electrode 11 (the separating position) to the contact point between the pair of rollers 17*a* and 17*b*, and which, when the result is $A<B$, produces an output signal of "1". Element 23 is a motor speed control circuit which, in accordance with the output from distinguishing circuit 22, can to increase the speed of revolution of motor M2 so that the foregoing roller pair's circumferential speed $V_2$ becomes substantially equal to circumferential speed $V_1$ of the photoreceptor drum. As is apparent from the above, in this example, the speeds of motors M1 and M2 are controlled so that circumferential speed $V_1$ of photoreceptor drum 4 and circumferential speed $V_2$ of heat roller 17*a* (in practice, the same as that of pressure roller 17*b*) are in advance set to have the relation of $V_1>V_2$ for the condition of $A>B$.

Thus, length B in the advance direction of copy paper P is detected by copy paper size sensor 20 and read out by copy paper size reading circuit 21, then the length B is compared by distinguishing circuit 22 with distance A from separation electrode 11 to the fixing position. As a result, if the relation is $A<B$, distinguishing circuit 22 produces a signal output of "1". Accordingly, motor speed control circuit 23 controls the speed of revolution of motor M2 to make circumferential speed $V_2$ of heat roller 17*a* substantially equal to circumferential speed $V_1$ of photoreceptor drum 4 ($V_1=V_2$); i.e., to increase the circumferential speed $V_2$. In this instance, when circumferential speed $V_2$ is increased, it is necessary to raise the fixing temperature with means (not shown), for increasing the heat produced by the heater built into heat roller 17*a* in order to obtain the optimum condition. In contrast, when, for example, B5-size copy paper is used, the relation becomes $A>B$, so that distinguishing circuit 22 does not produce a signal output of "1". Consequently, photoreceptor drum 4 and heat roller 17*a* are driven at speeds having a relation of $V_1>V_2$, the standard condition.

Thus, when length B of copy paper P is larger than distance A, the speed of revolution of motor M2 is controlled so that circumferential speed $V_2$ of heat roller 17*a* becomes substantially the same as circumferential speed $V_1$ of photoreceptor drum 4. Therefore, even if copy paper P is in the condition that its trailing end still remains in the image transfer position and its leading end is nipped by and between the rollers of the fixing device, the feed speed of copy paper P is by no means restrained, so that no blurred image problem at the trailing end of copy paper P will occur.

If length B in the transport direction of copy paper P is smaller than distance A, the apparatus according to the invention is very economical because the power to be supplied to the thermal source element built in the heat roller can be reduced.

Further, if photoreceptor drum 4 rotates at a considerable speed and if a copy sheet with its trailing end very close to the leading end of the subsequent copy sheet is led to the pair of rollers, the power to be supplied to the thermal source element cannot be reduced, but as a result, the fixing efficiency per unit time becomes improved. In addition, in the example, ejecting rollers 18 are provided. The rollers are controlled so as to rotate at the same speed as that of the heat roller.

Figure 3:
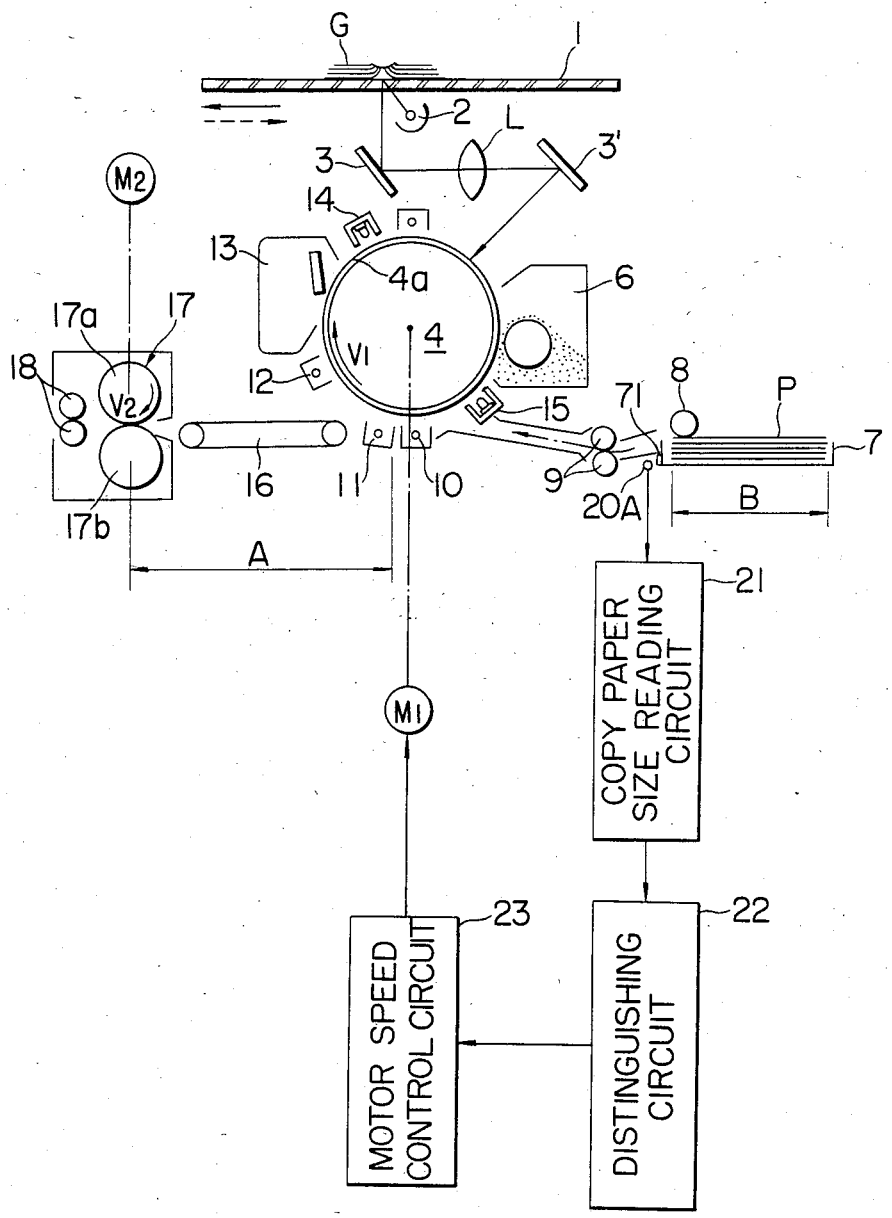
FIG. 3 is a schematic drawing showing one embodiment of an electrophotographic copying apparatus in accordance with another embodiment of the present invention.

FIG. 3 shows another example of the apparatus of the present invention. In this example, circumferential speed $V_2$ of heat roller 17*a* is made constant, contrary to the previous example, and the circumferential speed $V_1$ of photoreceptor drum 4 is varied. Because of this, the output from motor speed control circuit 23 is to be fed to driving motor M1 of photoreceptor drum 4. Other features of the construction are nearly the same as those of the example in FIG. 2. Also in this apparatus, the respective speeds of revolution of motors M1 and M2 are controllable so that the relation of circumferential speed $V_1$ of photoreceptor drum 4 with circumferential speed $V_2$ of heat roller 17*a* can be in advance set to be $V_1>V_2$ on the basis of $A>B$.

For this reason, in this example, the apparatus is so constructed that copy paper size sensor 20A is provided on the side of paper supply cassette 7. For example, a magnet 71 that corresponds to the size of the cassette used is suitably placed. The cassette size is read out by copy paper size reading circuit 21, and length B in the advance direction of copy paper P and distance A are then compared by distinguishing circuit 22. As a result, in the case of $A<B$, distinguishing circuit 22 produces a signal output of "1", according to which the speed of revolution of motor M1 is controlled to make circumferential speed $V_1$ equal to circumferential speed $V_2$ of heat roller 17*a* ($V_1=V_2$); i.e., to retard circumferential speed $V_1$.

Thus, in the mode wherein circumferential speed $V_1$ of photoreceptor drum 4 is retarded, in order to obtain an appropriate condition, it is necessary to have means (not shown) to lower the respective discharge voltages of electrode 5, image transfer electrode 10 and separating electrode 11, to reduce the respective quantities of light of illuminating lamp 2, exposure-prior-to-charging lamp 14 and exposure-prior-to-transfer lamp 15, and further to reduce the feed speed of copy paper P from the register rollers and the moving speed of document glass plate 1 (if the document glass plate is fixed and part of or the whole of the optical system is movable, the movable optical system corresponds to document glass plate 1).

In contrast, where the standard condition is $A>B$, such as in the case of, e.g., B5-size copy paper, because distinguishing circuit 22 produces no signal output of "1", the speed of revolution of motor M1 is controlled so that the speeds $V_1$ and $V_2$ return to the original $V_1>V_2$ state. Thus, even when length B of copy paper P is larger than distance A, the speed of revolution of motor M1 is controlled to make circumferential speed $V_1$ of photoreceptor drum 4 substantially equal to circumferential speed $V_2$ of heat roller 17*a*. Accordingly, as in the example of FIG. 2, the feed speed of copy paper P is not retarded at the position of fixing device 17, so that no blurred image problem occurs. In addition, the power to be supplied to the thermal source element built into heat roller 17*a* can be held down to a lower level than in the case where the transport speed of copy paper is relatively high. The construction in this example, therefore, is suitable for practical use.

A third example of this invention will be explained, utilizing FIG. 3. In this example, both motors M1 and M2 are variable. The standard condition is the case where, as in the above example, length B of copy paper is smaller than distance A, and the circumferential speed of the heat roller is smaller than that of the photoreceptor drum. In this instance, if the distinguishing means judges the relation between A and B as $A<B$, photoreceptor drum 4 and heat roller 17*a* are then controlled through motors M1 and M2 by the control circuit so that they run at an arbitrary same cirfumferential speed. At the same time, the respective speeds of document glass plate 1 and ejecting rollers 18, and the like, also are controlled appropriately. The functional effect of this construction not only solves the principal problems but appropriately with the handling of many different copy paper sizes. The construction, therefore, has the large advantage that it can widen the allowable range of designs for this apparatus.

In addition, in one of the examples of this invention, the length in the advance direction of copy paper P is detected. In a recording apparatus which uses a plurality of paper supply cassettes, however, the construction of it is allowed to be so designed that, when depressing the copying button after depressing the supply cassette-selecting button, the length in the advance direction of copy paper P is in advance detected according to the size, form, etc., of the selected supply cassette. And in the example, separate motors are independently provided for driving photoreceptor drum 4 and heat roller 17*a*. The driving may also be carried out otherwise, as for example with a single motor which is used to drive either one of photoreceptor drum 4 or heat roller 17*a* through variable gears, and the circumferential speed is varied by changing the gear ratio.

In the examples of the present invention, the recording apparatus has been described as of the contact type wherein a heat roller is used to fuse toner to perform heat fixation. However, in a recording apparatus which uses a noncontact-type fixing device that thermally fuses toner by such a radiation energy as infrared rays, the means for transporting copy paper inside the fixing device, e.g., rollers, etc., correspond to the heat roller and pressure roller because they transport copy paper dominantly in the foregoing roller-type fixing device. In addition, distance A from the separating position to the fixing position, which is compared with the length in the advance direction of copy paper, may be arbitrarily selected for designing within the interval between the separating position and the fixing position.

We claim:

1. In a recording apparatus having an electrostatic image support means and a fixing device, wherein the toner image formed on said electrostatic image support means is transferred onto a copy paper, and said copy paper is separated from the surface of said electrostatic image support means and then led to said fixing device to thereby fuse by heat said toner image to said copy paper, said recording apparatus comprising;

a distinguishing means for determining the relation in the length between the distance (A) from the separating position at which said copy paper is separated from said electrostatic image support means to the fixing position of said fixing device and the length (B) in the transport direction of said copy paper, distance (A) being shorter than the length (B) of the largest size of copy paper to be used, and a control means for controlling the relative circumferential speeds of said electrostatic image support means and said copy paper transport means provided inside said fixing device according to the output of said distinguishing means.

2. The recording apparatus of claim 1, wherein, when said length (B) in the transport direction of said copy paper used is larger than said distance (A) from said separating position to said fixing position, said distinguishing means provides an output signal to said control means to control the circumferential speed of said electrostatic image support means and that of said transport means so that both speeds are substantially the same.

3. The recording apparatus of claim 1, wherein, when said length (B) in the transport direction of said copy paper is used is the same as said distance (A) from said separating position to said fixing position, said distinguishing means provides an output signal to said control means to control the circumferential speed of said electrostatic image support means and that of said transport means so that both speeds are substantially the same.

4. The recording apparatus of claim 1, wherein, when said length (B) in the transport direction of said copy paper used is smaller than said distance (A) from said separating position to said fixing position, said distinguishing means provides an output signal to said control means to control the circumferential speed ($V_1$) of said electrostatic image support means and the circumferential speed ($V_2$) of said transport means so that $V_1$ $V_2$.

5. The recording apparatus of claim 1, wherein said electrostatic image support means is a photoreceptor.

6. The recording apparatus of claim 1, wherein said electrostatic image support means is a drum-type photoreceptor, and said copy paper transport means comprises a heat roller and a pressure roller which rotates with and pressing on said heat roller.

7. The recording apparatus of claim 1, wherein said electrostatic image support means comprises a dielectric.

8. In a recording apparatus having an electrostatic image support means and a fixing device, wherein the toner image formed on said electrostatic image support means is transferred onto a copy paper, and said copy paper is separated from said electrostatic image support means and then led to said fixing device, said recording apparatus comprising; a copy paper transport means provided inside said fixing device, distinguishing means, and control means coupled to said distinguishing means, wherein said control means keeps the circumferential speed of said copy paper transport means provided inside said fixing device to a smaller constant circumferential speed ($V_2$) than the circumferential speed ($V_1$) of said electrostatic image support means, and said distinguishing means determining the relation in the length between the distance (A) from the separating position at which said copy paper is separated from said electrostatic image support means to the fixing position of said fixing device and the length (B) in the transport direction of said copy paper, wherein the distance (A) is shorter than the length (B) of the largest copy paper to be used, and when said length (B) is determined by said distinguishing means to be longer than said distance (A), said speed ($V_1$) of said electrostatic image support means is automatically controlled by said control means to be substantially the same as said speed ($V_2$) of said copy paper transport means.

9. The recording apparatus of claim 8, wherein said copy paper transport means comprises a thermal source element-built-in heat roller and a pressure roller which rotates with and presses against said heat roller.

10. The recording apparatus of claim 8, wherein said electrostatic image support means is a drum-type photoreceptor and said copy paper transport means comprises a heat roller and a pressure roller which rotates with and presses against said heat roller.

11. The recording apparatus of claim 10, wherein said heat roller is a thermal source element-built-in roller.

12. The recording apparatus of claim 8, wherein said recording apparatus comprises a movable document glass plate and a fixed optical system for leading the image of an original document placed on said document glass plate onto said electrostatic image support means, and when said length (B) of said copy paper used is longer than said distance (A), the respective speeds of said movable document glass plate and said electrostatic image support means are reducedly controlled to be substantially the same as the circumferential speed of said copy paper transport means.

13. In a recording apparatus having an electrostatic image support means and a fixing device, wherein the toner image formed on said electrostatic image support means is transferred onto a copy paper, and said copy paper is separated from said electrostatic image support means and then led to said fixing device, said recording apparatus comprising a copy paper transport means provided inside said fixing device, distinguishing means, and control means coupled to said distinguishing means, wherein said control means keeps the circumferential speed ($V_1$) of said electrostatic image support means faster than the circumferential speed ($V_2$) of said copy paper transport means inside said fixing device, and said distinguishing means determines the relation in the length between the distance (A) from the separating position at which said copy paper is separated from said electrostatic image support means to the fixing position of said fixing device and the length (B) in the transport direction of said copy paper, and when said length (B) of said copy paper is longer than said distance (A), the distinguishing means provides a signal to the control means so that said speed ($V_2$) of said copy paper transport means is automatically increased by said control means to be substantially the same as said speed ($V_1$) of said electrostatic image support means.

14. The recording apparatus of claim 13, wherein said electrostatic image support means is a drum-type photoreceptor and said copy paper transport means comprises a heat roller and a pressure roller which rotates with and pressing on said heat roller.

15. The recording apparatus of claim 14, wherein said heat roller is a thermal source element-built-in roller.

16. The recording apparatus of claim 13, wherein said electrostatic image support means comprises a drum-type dielectric.

* * * * *

UNITED STATES PATENT AND TRADEMARK OFFICE

CERTIFICATE OF CORRECTION

PATENT NO. : 4,595,279

DATED : June 17, 1986

INVENTOR(S) : Hiroshi KURU et al

It is certified that error appears in the above-identified patent and that said Letters Patent is hereby corrected as shown below:

Title page, ABSTRACT, lines 11-12, change "of the copy paper in the transport direction" to --in the transport direction of the copy paper--.

Column 2, line 29, change "with" to --the--.

Column 4, line 37, after "no need" delete "of".

Column 5, line 28, after "can" delete "to".

Column 7, line 24, change "with" to --accommodates--.

Signed and Sealed this

Twenty-seventh Day of January, 1987

*Attest:*

DONALD J. QUIGG

*Attesting Officer* *Commissioner of Patents and Trademarks*